US005416994A

United States Patent [19]

McLaughlin

[11] Patent Number: 5,416,994

[45] Date of Patent: May 23, 1995

[54] LIQUID DISPLAY DEVICE

[75] Inventor: Thomas McLaughlin, Chappaqua, N.Y.

[73] Assignee: Technical Support Services Inc., Ossining, N.Y.

[21] Appl. No.: 17,109

[22] Filed: Feb. 12, 1993

[51] Int. Cl.[6] ..... G09F 19/00

[52] U.S. Cl. ..... 40/406; 40/414; 446/267

[58] Field of Search ..... 40/406, 409, 410, 414; 239/18, 20; 446/267, 485

[56] References Cited

U.S. PATENT DOCUMENTS

| | | | |
|---|---|---|---|
| 2,160,474 | 5/1939 | Jones et al. | 239/18 |
| 3,589,044 | 6/1971 | Morrison et al. . | |
| 3,711,698 | 1/1973 | Hess | 40/407 |
| 4,190,312 | 2/1980 | Bailey | 40/410 X |
| 4,265,402 | 5/1981 | Tsai . | |
| 4,490,931 | 1/1985 | Fleemin | 40/406 |
| 4,831,757 | 5/1989 | Sheehan . | |
| 5,018,288 | 5/1991 | yang | 40/406 |
| 5,272,604 | 12/1993 | Lin | 40/409 X |

*Primary Examiner*—Brian K. Green

*Attorney, Agent, or Firm*—Darby & Darby

[57] ABSTRACT

A liquid display device comprises an elongated, transparent, cylindrical display tube containing a column of liquid and including a light-transmitting base. A pedestal supports the display tube and includes a light-transmitting top plate on which the base of the display tube is seated. An impeller within the display tube rotates the liquid within the tube. The pedestal contains a reversible motor for driving the impeller, lights for lighting the contents of the display tube through the light-transmitting base and top plate, and air pumps for forcing air into the liquid within the display tube. A series of timers controls the operation of the motor, air pump and lights to create continuously changing turbulence patterns in the liquid.

8 Claims, 7 Drawing Sheets

FIG. 3
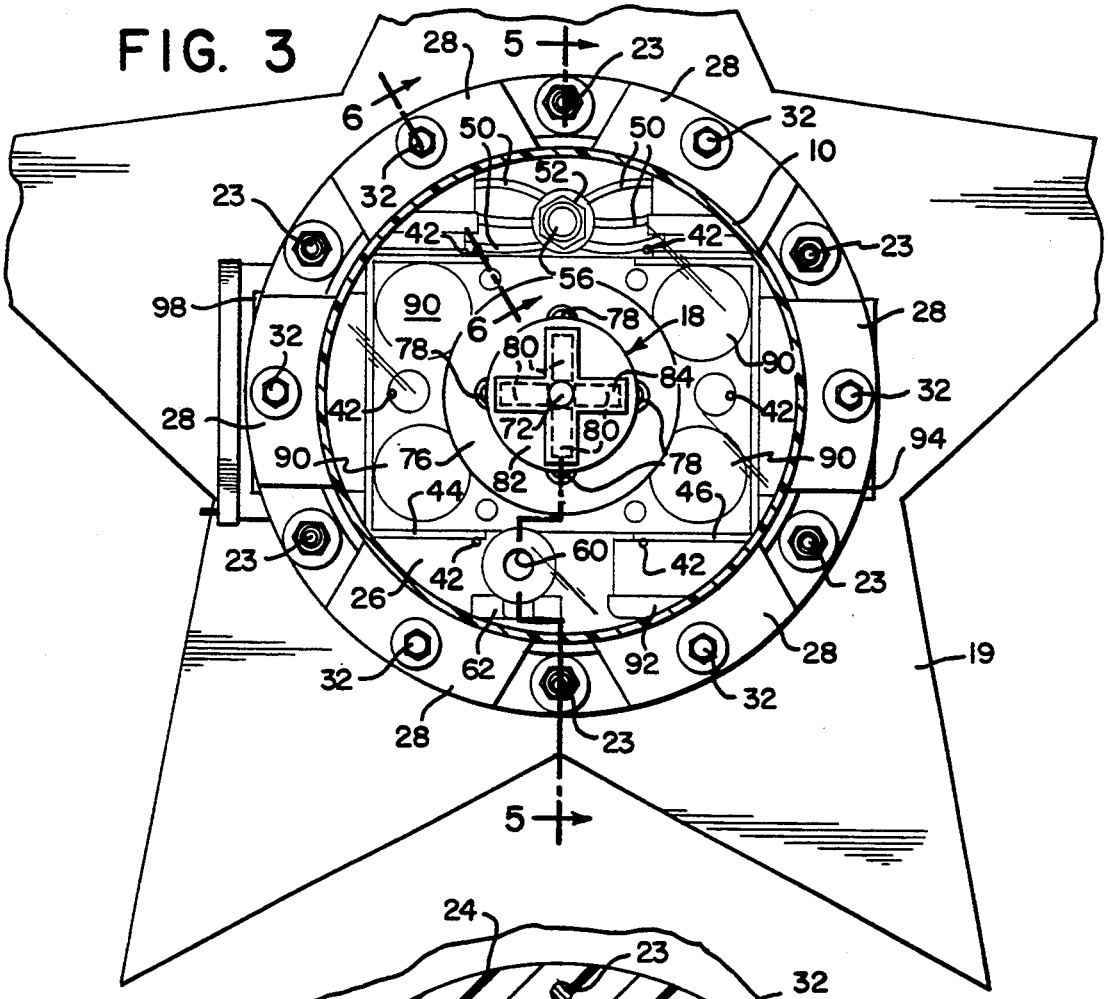
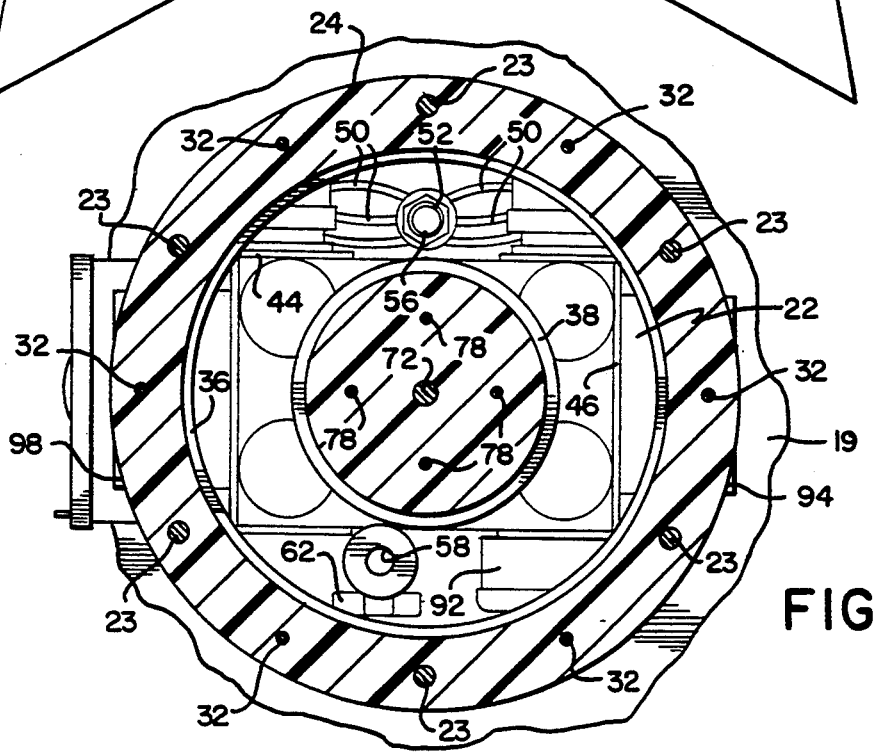
FIG. 4

FIG. 5
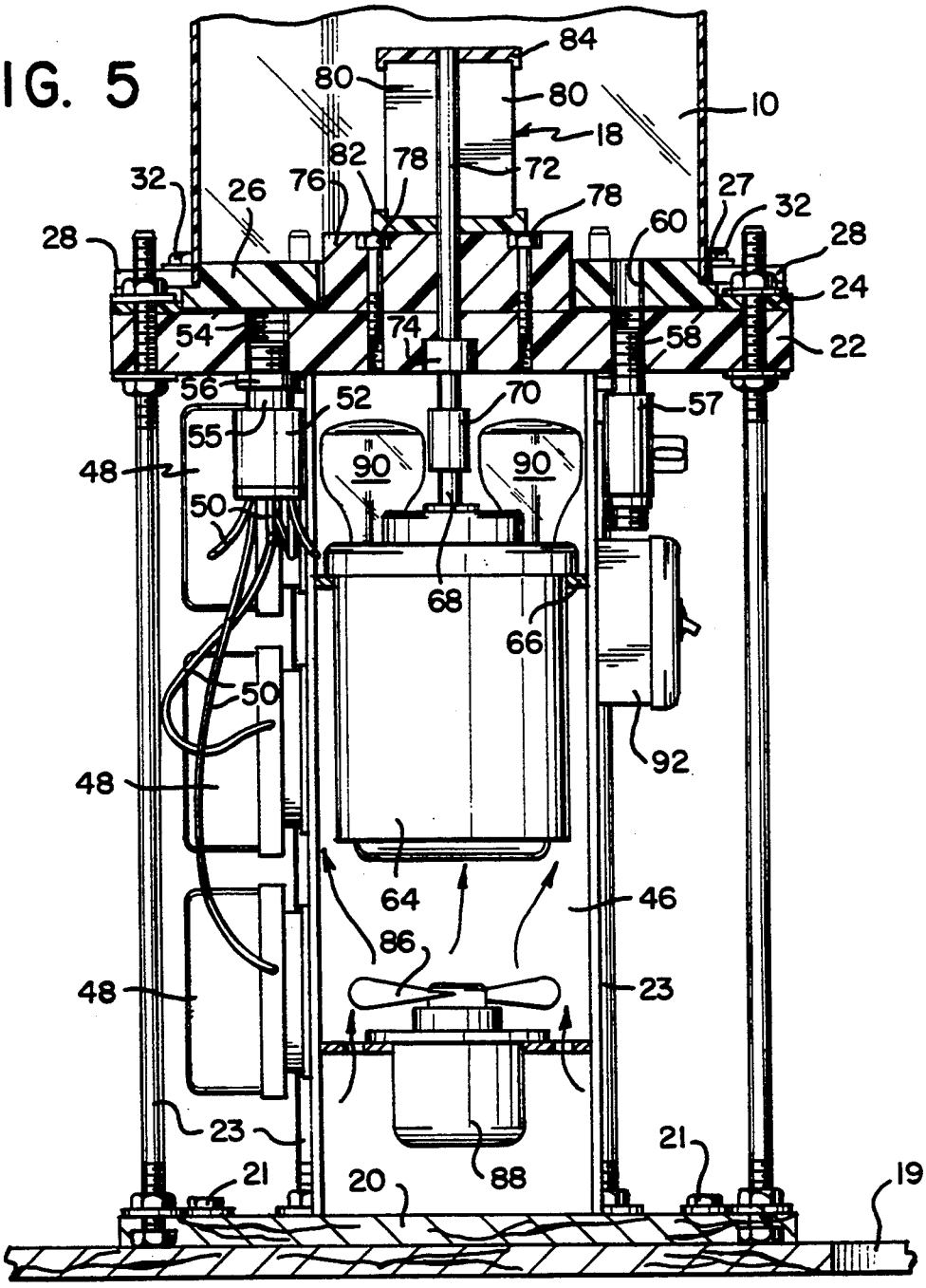
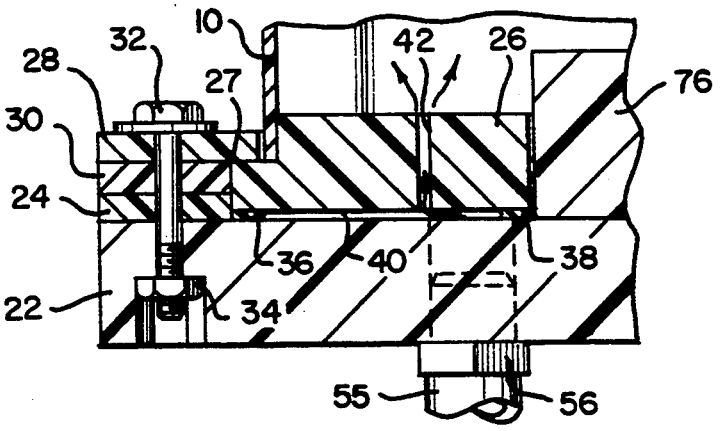
FIG. 6

LIQUID DISPLAY DEVICE

The present invention relates to a liquid display device intended primarily to be used at trade shows and conventions both as ornamentation and to attract attention. More particularly, the invention relates to a display device in which constantly changing sequences of unusual patterns are generated in a column of liquid.

Liquid displays are known in which attractive visual effects are created by causing a controlled turbulence in a body of liquid within a tank. Such displays are sometimes used at trade conventions or shows to direct attention to a particular display or simply as an ornamental device. The turbulence in the liquid provides an attractive, continuously varying, eye-catching display. In some cases, the displays serve as works of art in offices and even homes.

In such liquid displays, it is known to provide a column of water (or other liquid) in a cylindrical transparent tank with an impeller at one end of the tube to produce a vortex in the tube. The present invention relates to such a device, but is substantially improved as compared to known devices in that it provides for the capability of producing a multiplicity of different turbulence patterns which are enhanced by the introduction of air and the use of colored lights.

The main object of the invention is to provide a liquid display device for use in trade shows, conventions, or the like, but which, because of the extraordinary visual characteristics of the display, would have utility as a work of art in an office or home environment.

SUMMARY OF THE INVENTION

Briefly, in accordance with the invention, a cylindrical display tube is mounted on a pedestal. The base of the display tube and the top plate of the pedestal are light-transmitting. An impeller is mounted in the bottom of the display tube for imparting rotary movement to a column of water (or other liquid) within the display tube. The impeller is driven by a reversible motor which is housed in the pedestal. The pedestal also contains air pumps, lights and timers. When the device is turned on, the timers automatically control the direction of rotation of the motor, the introduction of air bubbles into the display tube, and the application of light to the display. By changing the direction of rotation of the motor, and even by turning the motor off, patterns in addition to vortices are produced within the liquid in the display tube. The timed introduction of air further modifies the appearance of the different patterns produced, and the overall effect is Still further enhanced by varying the lighting sequence of the display, including illuminating the display with different colored lights.

THE DRAWINGS

FIG. 3 is a cross-sectional view along the line 3—3 of FIG. 2;

FIG. 4 is a sectional view along the line 4—4 of FIG. 2;

FIG. 5 is a side-sectional view along the line 5—5 of FIG. 3;

FIG. 6 is a sectional view along the line 6—6 of FIG. 3;

DETAILED DESCRIPTION

Figure 1:
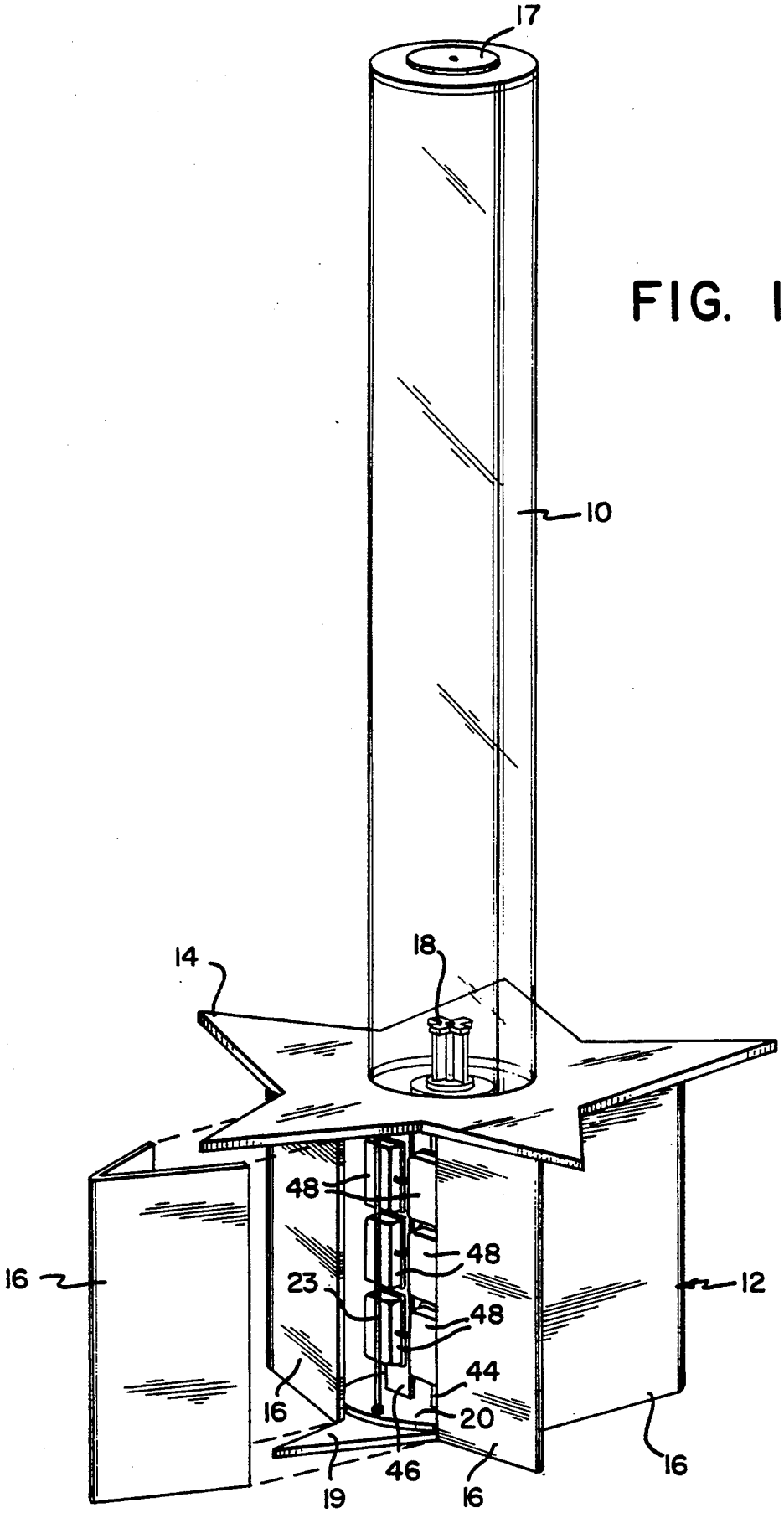
FIG. 1 is a perspective view of a liquid display device in accordance with a preferred embodiment of the invention.

In accordance with the invention, a transparent cylindrical display tube 10 is supported on a star-shaped pedestal 12. Pedestal 12 contains all of the operating mechanisms and controls for the display as described below. For aesthetic reasons, the pedestal is covered by a reflecting star 14 and side panels 16. FIG. 1 also illustrates the impeller 18, which produces the turbulence in the liquid (typically water) within the display tube 10, and six air pumps 48, which introduce air into the water. A transparent cover 17 is provided at the top of display tube 10 for cleaning purposes.

Figure 2:
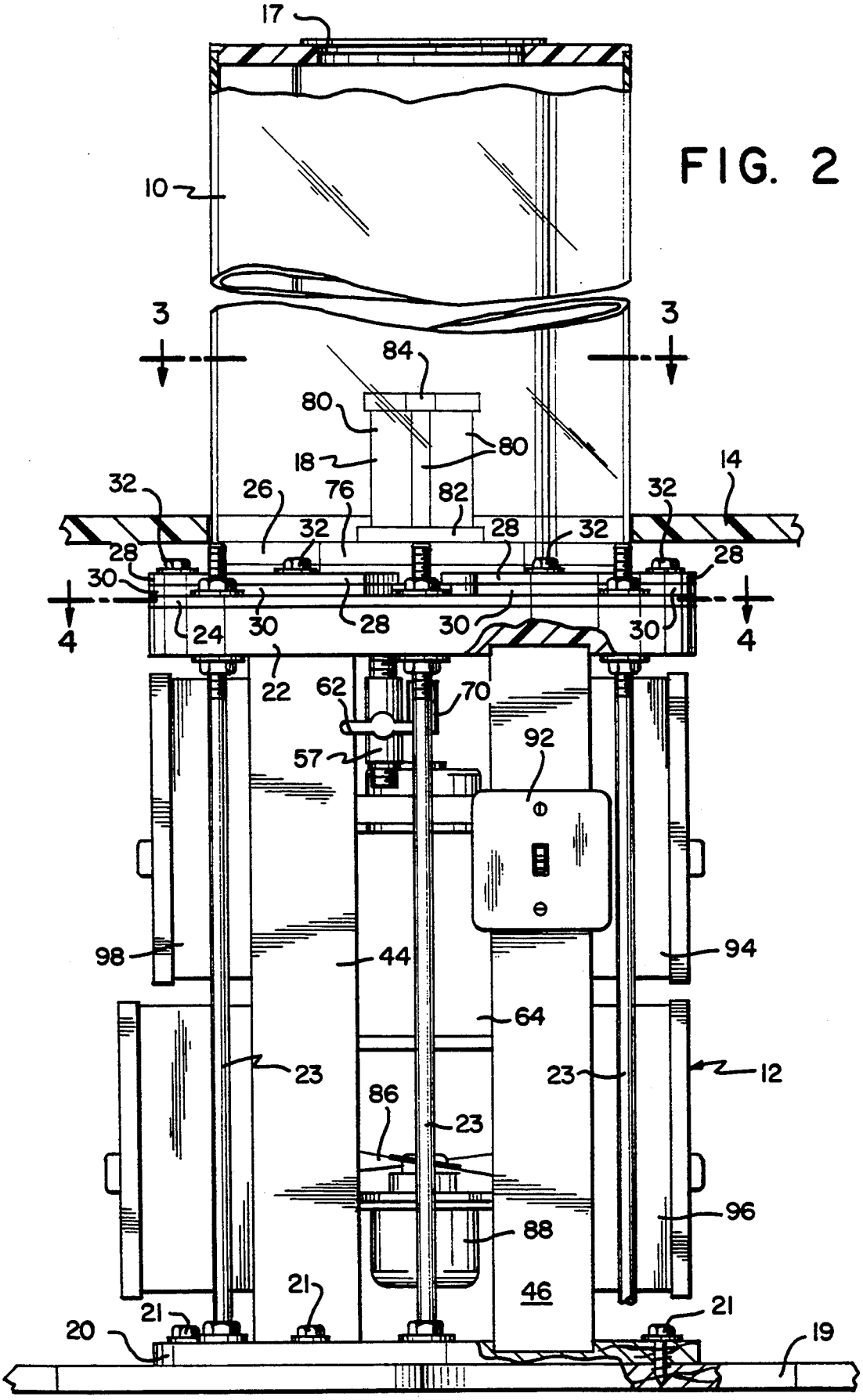
FIG. 2 is a side view partially in section of the display device.

The underlying support structure for the display tube is best shown in FIGS. 2, 5, and 6. The apparatus rests on a star-shaped base 19 which may be made of wood. A circular mounting plate 20, also made of wood, is attached to the star-shaped base 19 by six screws 21 (see FIG. 2). A transparent top plate 22 is supported on six rods 23, the ends of which are threaded to receive various nuts and washers (not numbered) between which the mounting plate 20 and top plate 22 are clamped as shown in FIG. 5. An annular retainer 24 rests on top of the top plate 22 and is retained in place by the support rods 23 and the associated nuts.

The bottom of the display tube 10 is sealed to a transparent display base 26 having a peripheral shoulder 27 positioned within the annular member 24. The display tube 10 sits on the shoulder 27 of display base 26 (FIG. 5), with the shoulder extending peripherally just beyond the tube.

Six equally-spaced clamps 28 (see FIGS. 3 and 6) are supported on similarly shaped spacers 30 and hold the display base 26 to the top plate 22 by means of bolts 32 and nuts 34. Outer and inner gaskets 36 and 38 (FIGS. 4 and 6) are positioned between the top plate 22 and the display base 26 to provide an annular air gap 40 which communicates with six air passageways 42 through the display base 26 (see FIG. 3) to introduce air into the liquid within display tube 10.

U-shaped stanchions 44 and 46 are suitably supported between the mounting plate 20 and the top plate 22 (FIGS. 2, 3, and 5). Six air pumps 48, which may be conventional, are mounted on the stanchions 44 and 46 (see FIGS. 1 and 5) with outlet air hoses 50 from the air pumps being coupled to an air manifold 52. The top plate 22 includes a threaded duct 54 to which a coupling 56 is connected so that air from the manifold 52 can be forced into tile air gap 40 between display base 26 and top plate 22. Thus, when the air pumps are turned on, air is pumped from the six pumps. 48 through outlet hoses 50 to manifold 52 and through duct 54 and air passageways 42 into the liquid within the display tube 10. A valve 55 prevents water from flowing into the manifold 52.

Water or other liquid is introduced into the display tube 10 through a spout 57, which can be screwed into a threaded bore 58 within the top plate 22. Display base 26 includes a duct 60 through which water is pumped into or removed from the display tube. A gasket 61 (FIG. 4) prevents water leakage into gap 40. Spout 57 is capable of attachment to a conventional hose fitting and includes a valve 62 for opening and closing the spout so that the display tube can be filled and emptied through spout 57.

The motor which rotates the impeller 18 is shown at 64 (FIG. 5) and is supported on a ledge 66 secured to the stanchions 44 and 46. The motor includes an output shaft 68, which is connected to a drive shaft 72 by means of a standard coupling device 70. The drive shaft 72 is supported within a bushing 74 mounted in a suitable recess (not numbered) in the bottom of the plate 22.

A circular plate 76 is attached to the top plate 22 by means of bolts 78, which engage threaded apertures (not numbered) within the plate 22. Plate 76 fits within the opening of the annular display base 26. Impeller 18 is attached to the drive Shaft 72 and rotates above the plate 76. The impeller 18 includes four blades 80 suitably retained between circular and cross-shaped members 82 and 84, respectively. As shown in FIG. 5, the blades 80 may be seated in complementary grooves in the members 82 and 84 for structural rigidity. Preferably, the impeller blades are made of a transparent plastic with the parts being secured by means of an adhesive.

If the invention is to be used at a trade show or the like, the display tube 0 may be seven feet, nine inches tall and twelve inches in outer diameter. When a tube this size is filled with water, a fairly large motor is required to drive the impeller. In the preferred embodiment, a single phase, single speed 60 cycle 115 volt, three-quarter horse power motor was used successfully to drive the impeller. In the preferred embodiment, a fan 86 and its motor 88 are mounted beneath the driving motor 64 to cool the motor 64.

As indicated above, lighting of the vortex is a significant aspect of the invention. In the preferred embodiment, four light bulbs 90 are supported on mounting ledge 66 (FIGS. 3 and 5). Because the top plate 22, display base 26 and central plate 26 are transparent, light from these bulbs is directed into the liquid within display tube 10.

As shown in FIG. 2, an on/off switch 92 is mounted on one of the arms of stanchion 46. Two timers 94 and 96 are mounted on a transverse portion of stanchion 46, and a third timer 98 is mounted on the opposite stanchion 44. On/off switch 92 is used to start the display device. Timers 94, 96 and 98 control the direction of rotation of motor 64, actuation of the air pumps 16 and the timing of the four lights 90. The electrical wiring required to power the various parts of the display device are not illustrated in the drawings for purposes of clarity.

Figure 7:
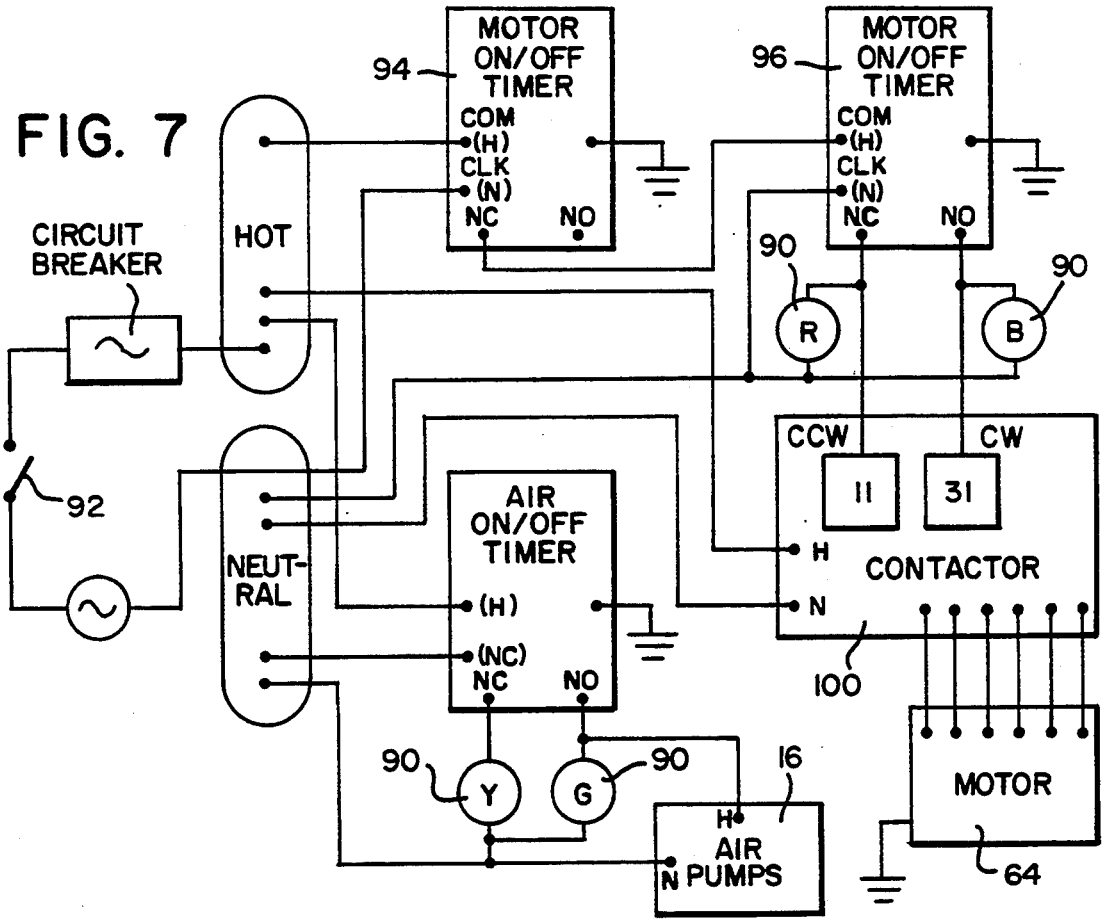
FIG. 7 is a schematic wiring diagram showing the electrical connections between the various timers and the lights, air pumps and reversible motor.

FIG. 7 is a schematic wiring diagram for the electrical circuits of the display device. The electrical portion of the display may employ conventional devices and such devices as well as the manner in which they are connected form no part of the invention.

In FIG. 7, the parts identified in FIGS. 1–6 are identified by the same numerals. The four lamps 90 are distinguished by the letters R, B, Y and G which, in the illustrative example, represent red, blue, yellow and green. As indicated in FIG. 7, timer 94 is used to turn the motor 64 on and off for selected periods of time. When the motor is on, the timer 96 controls the direction of rotation pursuant to its programmed sequence. As illustrated, when motor 64 is caused to rotate counter-clockwise the red light 90 is lit; when the motor 64 rotates clockwise, the blue light 90 is lit.

Timer 98 controls the air pumps 16 and the yellow and green lights 90. When air pumps 16 are "on", the green light 90 is lit; when the air pumps are deactivated, the yellow light 90 is lit.

Figure 8:
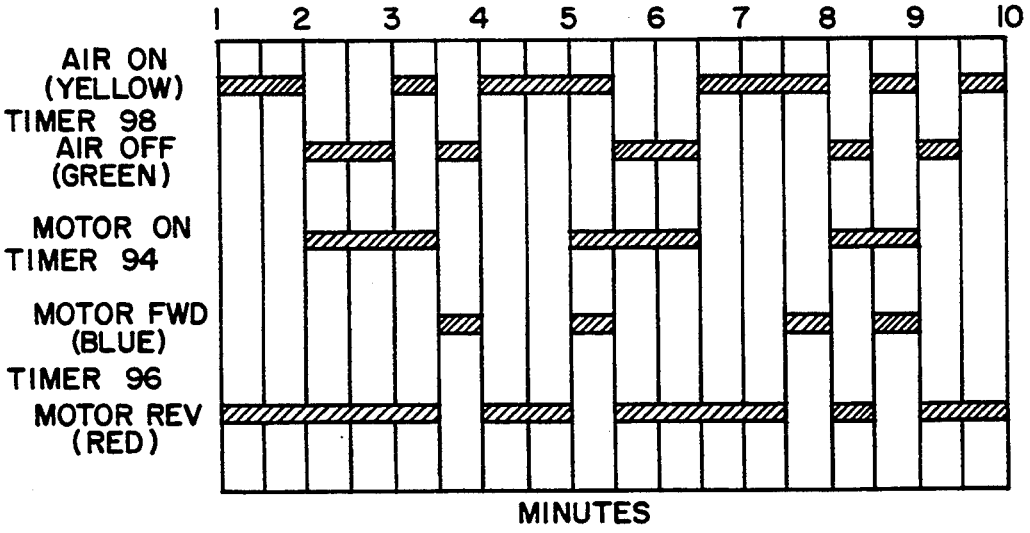
FIG. 8 is a timing chart showing one sequence of activating the motor, air pumps and lights in accordance with the preferred embodiment.

FIG. 8 is a timing chart showing the timing sequence of the various timers in a typical timing sequence. In the timing sequence represented in FIG. 8, the motor on-off timing disrupts the motor forward-reverse timing. This results in a more "random" presentation of water patterns.

The display tube 10, its base 26 and top plate 22 are preferably made of transparent acrylic plastic. In the preferred embodiment, the central plate 76 and the impeller 18 may also be made of a transparent acrylic plastic. Polyvinylchloride may be used for plastic parts which need not be transparent.

The combination of the air, reversible motor and multi-colored lights enables the production of surprising and attractive turbulence patterns in the liquid within the display tube. In a steady state condition, i.e, with motor 64 operating in one direction, a vortex ultimately is formed. The introduction of the air generates a multiplicity of small bubbles which move through the vortex and likewise create attractive patterns. If motor 64 is turned "off" or reversed, the pattern changes dramatically, and the effect can be enhanced by varying the introduction of the air and/or the lighting. While, obviously, the patterns are never exactly the same, FIGS. 9–15 show representative patterns for the timing pattern of FIG. 8. These photographs illustrate the capacity of a display device in accordance with the invention to provide a variety of unusual constantly changing patterns, the effect of which is enhanced by the selected timing of the different colored lights.

The chart below gives the period for each of the photographs and the condition of the air pumps and motor for that period.

Figure 11:
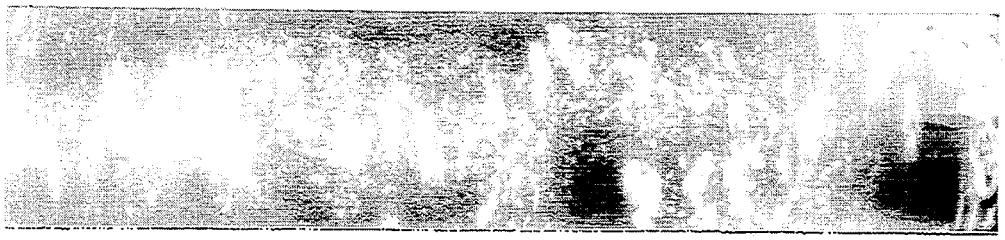
FIGS. 9–15 are photographs showing representative patterns as they appear at various times during the cycle of FIG. 8.
Figure 10:
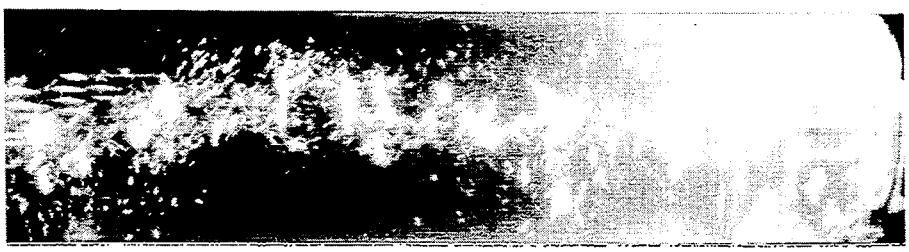
Figure 9:
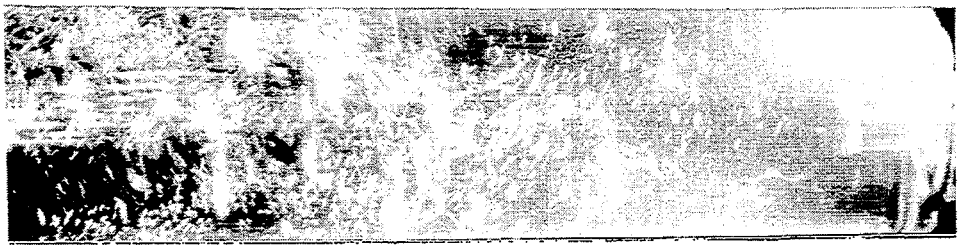
Figure 15:
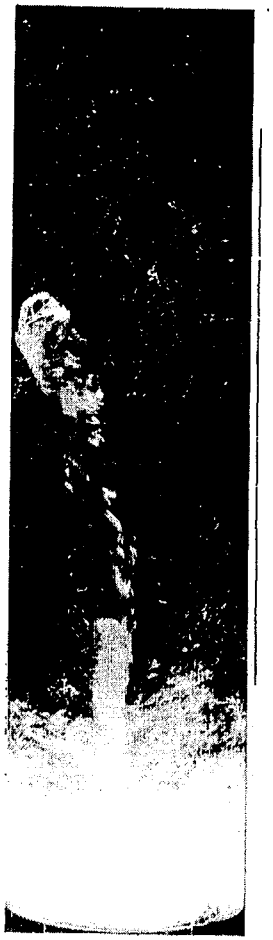
Figure 14:
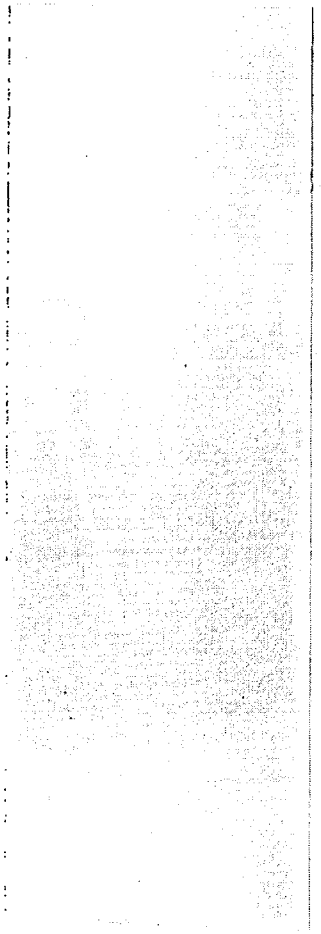
Figure 13:
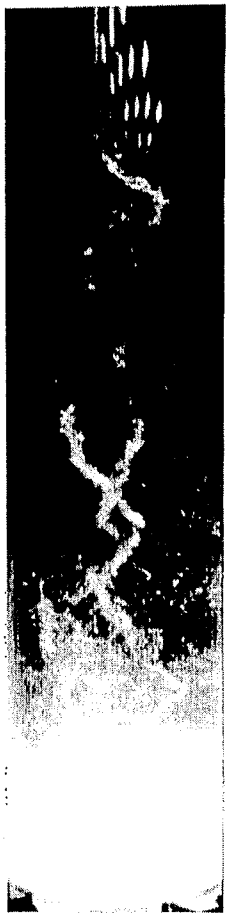
Figure 12:
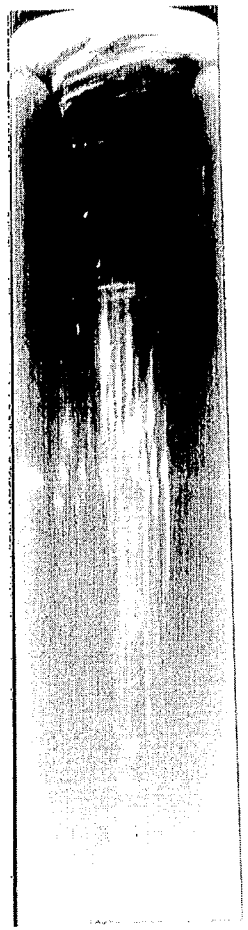

| FIG | TIME | CONDITION |
|---|---|---|
| FIG. 9 | 4-½–5 minutes | Air on, motor off |
| FIG. 10 | 5–5-½ minutes | Air on, motor just on |
| FIG. 11 | 6–6-½ minutes | Air off, motor on |
| FIG. 12 | 2–3 minutes | Air off, motor on |
| FIG. 13 | At 5-½ minutes | Air just off, motor on |
| FIG. 14 | At 6 minutes | Air off, motor just off |
| FIG. 15 | 6–7 minutes | Air on for last 30 seconds, motor off |

What is claimed is:

1. An article of manufacture, comprising:

an elongated, light-transmitting display tube, said display tube including a light-transmitting base and containing a liquid, a pedestal for supporting said display tube, said pedestal including a light-transmitting top plate on which the light-transmitting base of said display tube is seated, an impeller within said display tube for rotating the liquid within said display tube to generate a vortex in said liquid, a motor within said pedestal for driving said impeller, lighting means mounted within said pedestal for lighting the liquid with said display tube, the light from said lighting means passing through said light-transmitting base and top plate, means mounted within said pedestal for pumping air into the liquid within said display tube and sealing means between said top plate and said light-transmitting base, said sealing means providing a gap between the light-transmitting base and top plate, said light-transmitting base further including at, least one air passageway therethrough, and wherein said pumping means pumps air into said display tube through said gap and air passageway.

2. An article of manufacture according to claim 1, wherein said lighting means includes a plurality of different colored lights.

3. An article of manufacture according to claim 1, including timer means for actuating said motor and said pumping means, and for controlling the lighting of said lighting means.

4. An article of manufacture according to claim 3, wherein said display tube is cylindrical.

5. An article of manufacture, comprising:

an elongated, light-transmitting display tube, said display tube including a light-transmitting base and containing a liquid, a pedestal for supporting said display tube, said pedestal including a light-transmitting top plate on which the light-transmitting base of said display tube is seated, an impeller within said display tube for rotating the liquid within said display tube to generate a vortex in said liquid, a motor within said pedestal for driving said impeller, said motor being a reversible motor so that said impeller can be caused to rotate clockwise or counter-clockwise, lighting means mounted within said pedestal for lighting the liquid with said display tube, the light from said lighting means passing through said light-transmitting base and top plate, means mounted within said pedestal for pumping air into the liquid within said display tube, and sealing means between said top plate and said light-transmitting base, said sealing means providing a gap between the light-transmitting base and top plate, said light-transmitting base further including at least one air passageway therethrough, and wherein said pumping means pumps air into said display tube through said gap and air passageway.

6. An article of manufacture according to claim 5, wherein said lighting means includes a plurality of different colored lights.

7. An article of manufacture according to claim 5, including timer means for actuating said motor; and said pumping means and for controlling the lighting of said lighting means.

8. An article of manufacture according to claim 7, wherein said display tube is cylindrical.

* * * * *